US006552963B2

(12) United States Patent
Baranek et al.

(10) Patent No.: US 6,552,963 B2
(45) Date of Patent: Apr. 22, 2003

(54) FIREARM DISCHARGE DETECTION DEVICE AND WARNING SYSTEM

(75) Inventors: John Baranek, 13727 Fairgate Dr., Poway, CA (US) 92064; James Russell, National City, CA (US)

(73) Assignee: John Baranek, Poway, CA (US)

( * ) Notice: Subject to any disclaimer, the term of this patent is extended or adjusted under 35 U.S.C. 154(b) by 0 days.

(21) Appl. No.: 09/758,634

(22) Filed: Jan. 10, 2001

(65) Prior Publication Data

US 2003/0021188 A1 Jan. 30, 2003

Related U.S. Application Data

(60) Provisional application No. 60/175,194, filed on Jan. 10, 2000.

(51) Int. Cl.[7] ..... G08B 21/00
(52) U.S. Cl. ..... 367/136; 367/129; 367/906
(58) Field of Search ..... 367/136, 906, 367/124, 129; 340/540

(56) References Cited

U.S. PATENT DOCUMENTS 5,703,835 A * 12/1997 Sharkey et al. ..... 367/906
5,917,775 A * 6/1999 Salisbury ..... 367/906
6,281,792 B1 * 8/2001 Lerg et al. ..... 340/540

* cited by examiner

*Primary Examiner*—Daniel T. Pihulic
(74) *Attorney, Agent, or Firm*—Donn K. Harms

(57) ABSTRACT

A firearm discharge detection device and alarm system featuring a plurality of detector units placed inside a structure which communicate with a central monitoring unit. Each detection unit will detect the discharge of a firearm in its proximity from decibel levels and duration using on board filters and timers and thereon signal the central monitoring unit. A digitized embodiment may also be used to determine the sound of a firearm using a digitized fingerprint of the sound compared to an library of firearm sounds in onboard memory by a microprocessor. The central monitoring unit will thereupon communicate with all the other detection devices installed to sound an audible and/or visible alarm to occupants to exit. Concurrently the central monitoring unit will communicate the firearm discharge and location to police. An optional directional exit alarm or warning to hide may also be activated.

18 Claims, 4 Drawing Sheets

FIREARM DISCHARGE DETECTION DEVICE AND WARNING SYSTEM

This application is a Continuing in Part Application and claims the benefit of application No. 60/175,194 filed Jan. 10, 2000.

BACKGROUND OF INVENTION

1. Field of Invention

The present invention relates to an alarm and warning system. More particularly it relates to a device which detects the discharge of a firearm inside or outside of a building and once detected issues a warning to occupants of the building of the discharge. The device in one embodiment will also direct occupants of the building to the nearest exit that is in a direction away from the point of discharge of the firearm in that building.

2. Prior Art

Modern society in industrialized nations tends conduct business inside of office and industrial buildings where workers work at assigned stations or in assigned offices in such buildings. Consequently, office buildings and commercial and industrial buildings tend to house hundreds if not thousands of employees on any given workday who complete their assigned tasks in an office environment.

With so many workers conducting business inside of buildings there is a constant threat to their safety from emergencies such as fire or hazardous chemicals. To protect workers from such hazards currently most buildings have some sort or warning system to inform employees and building occupants of an occurrence such as a fire that demands their immediate exit from the building for their safety.

However modern society has evolved to present another clear and present danger to employees and occupants of offices and commercial and industrial buildings. It is a common occurrence in modern society for a deranged individual for known or unknown reasons, to bring a firearm into such buildings and discharge that firearm inside.

While the danger to other employees, visitors, and occupants of a building from an individual discharging a firearm is extreme, currently there is no known system to detect such a firearm discharge and to warn occupants of the building of the danger. Fire alarms may warn of fire or chemical hazards and security guards might warn persons in their immediate vicinity of a perceived danger, however there exists no system to warn building occupants of a discharge of a gun or firearm style weapon inside the building and give them time to exit should the gunfire continue.

As such there exists a need for a device that will detect the discharge of a firearm inside of a building and identify the position of that discharge inside the building. Such a device should also be capable of warning occupants of the building in the event of such a firearm discharge. Such a device in its best mode should also endeavor to direct occupants of the building to an exit that is in a direction away from the site of the firearm discharge and out of harms way.

SUMMARY OF THE INVENTION

Applicant's device provides an easily installed and operated alarm system for the detection of a firearm discharge inside or outside of a building or structure. The disclosed device herein features a plurality of remote firearm discharge detectors which constantly monitor the area proximate to their installation. Each such detector has thereon a means to detect the discharge of a firearm from the electronic signal generated by a sonic wave that a firearm transmits on discharge.

Once the detector has determined from predetermined parameters that a firearm has indeed been discharged in the proximity of the detector, an electronic signal is communicated to a remote central monitoring unit which determines from the signal communicated the exact location of the detector which has determined that a firearm has in fact been discharged. The central monitoring unit therein communicates two different alarm warnings. The first warning is to employees and other occupants of the monitored building that a firearm has been discharged. This is accomplished by the central monitoring unit communicating a signal to all other detector units in the building to sound an alarm in those units. The alarm would be audible or visible or both and would warn persons in the general proximity of each detector unit and would warn persons proximate thereto that a gunshot has been detected by another detector in the building and to exit the structure.

The audible alarm could be a simple buzzer or other similar audible warning or could be a prerecorded voice warning of a gunshot detection, and to immediately exit the structure. Additionally, the alarm transmitted by each detector could be visible in the form of a light or lights on each detector emitting a visible signal to exit the building. Optionally, the visible alarm could be an arrow or similar directional indicator that would direct building occupants toward a building exit away from the point of discharge of the firearm that has been detected. Occupants of the building proximate to any detector would therefor have both an audible alarm, a visible alarm, or both, to warn and direct them to exit.

Additional utility is provided by the disclosed device in the form of a transmission to police or security personnel of the discharge of a firearm in the building being monitored and the exact location of that discharge. This would be accomplished by the central monitoring unit using the telephone, or wireless broadcast of a warning to predetermined police or security personnel concurrent with the alarm sent by the central monitoring unit to the plurality of detectors to sound the alarm to building occupants.

The device features a means to detect the discharge of a firearm from the sonic wave generated by the firearm, located in each detector unit which in the current best mode features communication with a microphone or transducer to continually monitor the area proximate to the location of the detector. Sonic waves monitored by the transducer are communicated through an amplifier and though filters which only pass a signal that is between a certain high point and low point on the decibel scale. The signal therein passed by the filters is then timed by the detector for duration and then determines if the passed signal is of a predetermined length. If the signal received and transmitted by the transducer is of a sufficient decibel and for a sufficient time duration, it is determined by the detector to be a firearm discharge. The detector will then transmit a signal to the remote central monitoring unit which will activate all the other detectors mounted in the building to sound the alarm and concurrently communicate a signal to police or security personnel of the discharge. As noted, additional utility may be provided by provision of directional indicators on each detector unit to direct exiting occupants to an exit away from the site of the firearm discharge.

An object of this invention is providing a warning to occupants of a building or structure of the discharge of a firearm inside that structure.

Another object of this invention is to communicating to police or security personnel the exact location of a firearm discharge inside of a building.

A further object of this invention visually direct building occupants to leave the building by a route that will take them away from the site of the firearm discharge.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
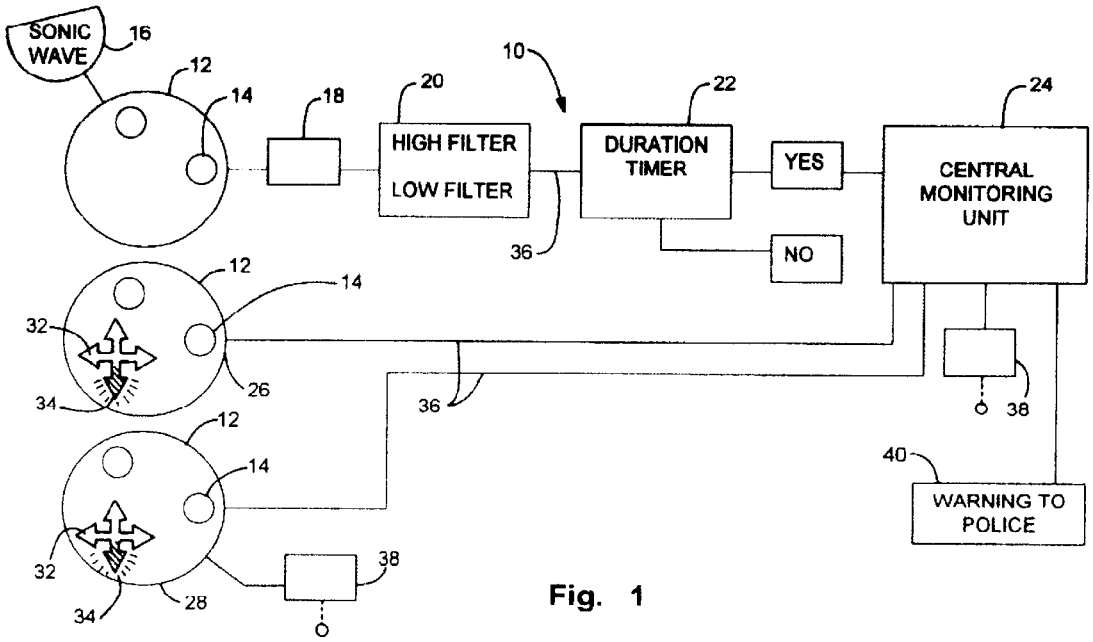
FIG. 1 is a depiction of the overall operation of the system showing the components and interaction thereof.
Figure 2:
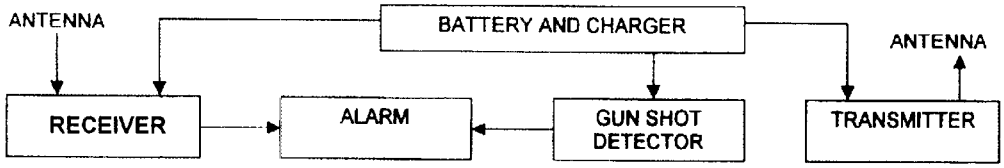
FIG. 2 is a depiction of the components of the detector unit.
Figure 3:
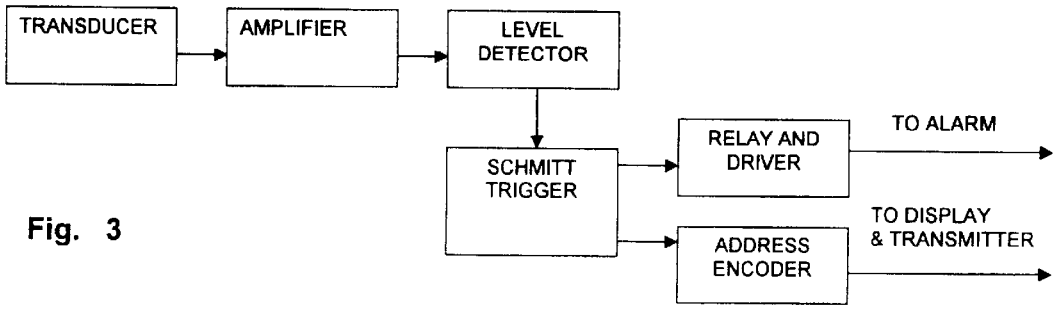
FIGS. 3–7 are block diagrams depicting the components of the detector system.
Figure 4:
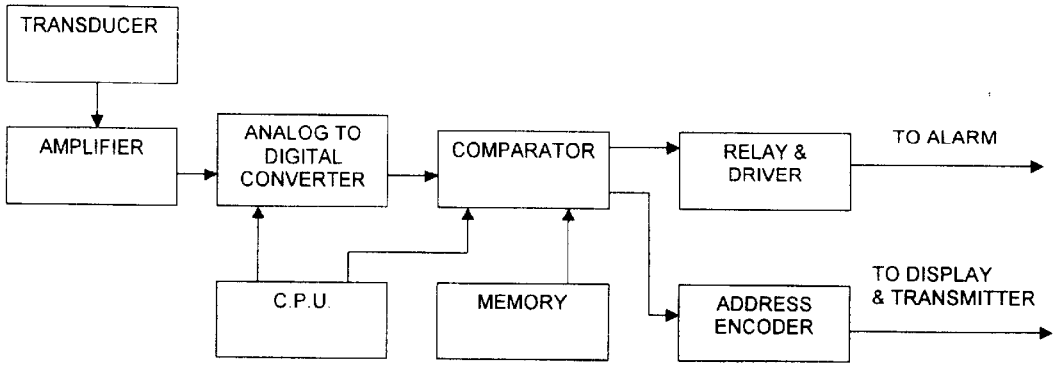
Figure 5:
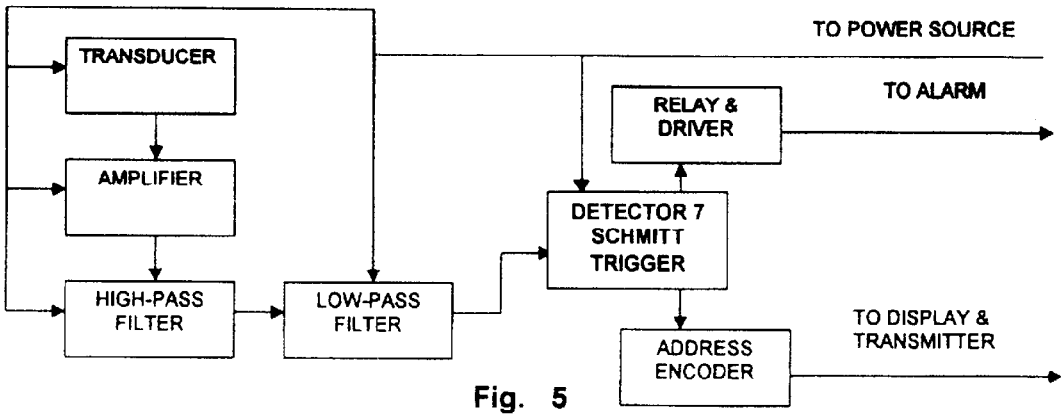
Figure 6:
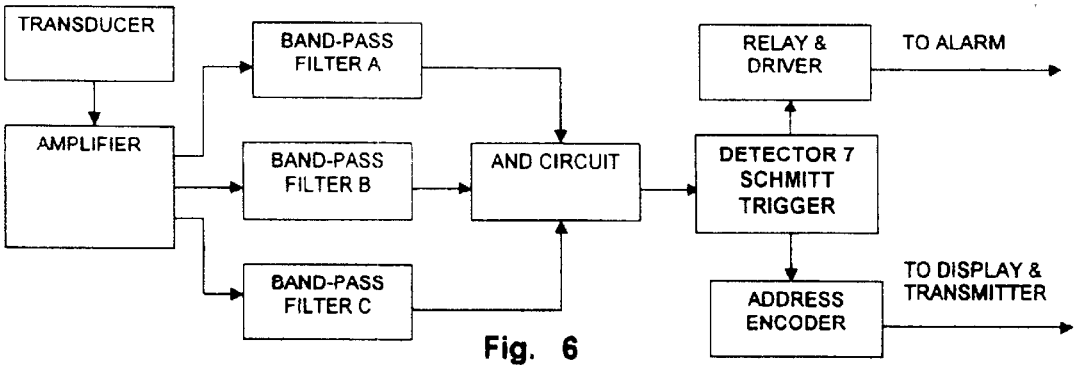
Figure 7:
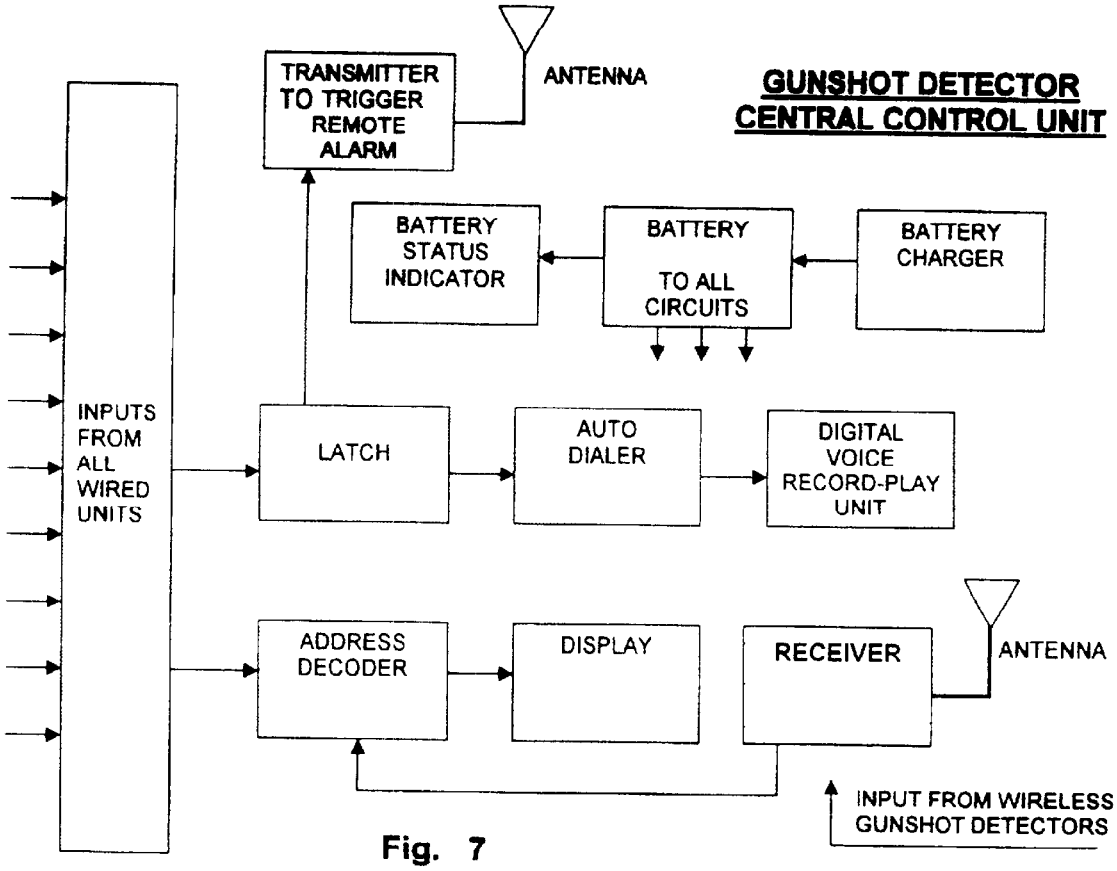

Referring now to the drawing FIGS. 1–7 which depict the preferred embodiments of the invention disclosed herein, specifically FIG. 1 which depicts in flow chart form the operation of the disclosed firearm discharge device 10.

The device features at least one detector unit 12 mounted in a structure in a location remote to a central monitoring unit 12. Each detector unit 12 installed would be powered by conventional power means such as a battery or AC power or a combination thereof which would protect the system from power outages. The device 10 features a means to detect a firearm sound discharge from the decibel level and duration of the sonic wave generated by the firearm which is located inside each detector unit 12 which in the current best mode communicates with and which receives electronic signals representative of the decibel level and duration of sounds proximate to the detector unit 12 from a means to detect a sonic wave in the form of a microphone or transducer 14 to thereby continually monitor the area proximate to the location of the detector. Decibel levels and time span of the sonic waves 16 monitored by the transducer are pro proportionally communicated electronically in analog fashion to the means to detect a firearm discharge which in the current best mode is constructed of an amplifier 18 which receives the electronic signal from the transducer 14 and therein amplifies and communicates the signal through a signal filter 20. The signal filter 20 can be manufactured in a number of fashions using a simple level detector 19 which passed the signal onto a duration detection means to time the signal so passed. In this manner the signal is checked for both decibel level and duration and matched with criteria about the same with firearms discharge and if the signal meets the duration and decibel requirements it is again passed on.

The signal filter 20 in one current preferred embodiment is comprised of three pass filters 21 to identify and communicate a signal received from the amplifier 18 which must be at a predetermined high point and low point to pass through the signal filter. Another embodiment of the signal filter 20 would feature a high pass filter 27 and a low pass filter 29 which would pass signals from the amplifier which are only in the range between the determined high point and low point to pass. of course other manner of constructing such a signal filter 20 to pass the signal from the transducer 14 can be made by those skilled in the art, and such are anticipated.

In operation, the amplified signal from the transducer enters the filter means or signal filter 20. In one mode if the signal from the amplifier 18 meets the predetermined criteria to reside in the range between predetermined high pass filter 27 and low pass filter 29 to traverse the signal filter 20 it is transmitted to the timing means to time duration as an output signal 23. Or, using the separated signals from the three band pass filters 21 which converge and communicate with an "and" circuit which will produce and output signal 23 and communicate it to a trigger means such as a detector and schmitt trigger 22 which will time the duration of the wave produced by the sonic wave or sound and which will only pass the output signal 23 if it meets criteria of preset level and proper timing length or duration.

Once passed the filter means or signal filter 20 if the output signal 23 is of a predetermined length and level between the high point and low point, it is determined to be a firearm discharge and the output signal 23 is passed by the schmitt trigger to be communicated to the central monitoring unit 24. Along with the output signal 23 onboard information determining exact location of the detector from a stored address onboard the detector unit 12, such as a serial number, code, or G.P.S. location, is communicated to the central monitoring unit 24.

Receipt of the output signal 23 from a tripped detector unit 12 alerts the central monitoring unit 24 that the individual tripped detector unit 12 has detected a firearm discharge in its proximity. If desired by the user, the tripped detector 12 could also initiate the onboard audible alarm means 30 and visible alarm means 32 of the tripped detector unit 12. Optionally, the means to detect a firearm discharge could reside in the central monitoring unit 24 with the detector units 12 then relaying the electronic signal generated by the sounds received from the transducer 14 or microphone and the filter 20 and the calculation for time and decibel levels would occur at the central monitoring unit 24. However in the current best mode the means to detect the discharge of a firearm would reside in each detector unit 12 to avoid any interference that might be communicated with the sound only to the central monitoring unit 24 which might cause false or failed alarms. The central processing unit 24, like each detector unit 12, would also be powered by conventional power means such as a battery or AC power or a combination thereof which would protect the system from power outages.

With the signal of a firearm discharge being received, the central monitoring unit 24 will then communicate with and activate all the other detectors 26 and 28 mounted in the building to broadcast an alarm. The alarm broadcast by the other detectors 26 and 28 can be either audible or visual or both. In the case of an audible alarm a speaker 30 or other means to broadcast an audible alarm would audibly transmit sounds to warn of a firearm discharge. The audible warning can be either a noise such as a beeper or buzzer, and/or a recorded voice message warning occupants to exit the building being monitored.

Should a visible warning means such as a light emitting diode (LED) 32 be employed in combination with or addition to the audible warning means such as the speaker 30, it could consist of a simple blinking LED 30. Or, in the current best mode of the device the visible warning means would be directional to thereby direct occupants of a route of exit away from the discharged firearm. Here such a directional beacon is depicted as LED's in the form of an arrow 34 indicating the best exit route away from the discharged firearm at the time.

Sometimes however, if the firearm is discharged and the only route from a location of a detector unit 12 out of the building, is past the shooter, it may be safer to stay put and hide. As such, a third visible alarm in the form of a warning to hide light 35 or LED can be provided so that occupants of the building who will have to cross paths with the shooter to exit will be able to see the hide light 35 and find the best hiding place available.

Means for communication between the detector units 12 and the central monitoring unit 24 would be provided by wires 36 such as conventional twisted pair, or category five network cables or by a radio or optical transceiver 38 at both the central processing unit 24 and the detector units 12. The transceivers 38 would be of the low power variety authorized by the FCC for local communications between such devices and would provide two way communication between the detector units 12 and the central processing unit 24. In this fashion, two way communication could be accomplished using an existing computer network in the structure, or by new wiring for the installation of the device 10 or by setting up frequencies for the transceivers 38 to operate with at the installation. A similar means for communication would be used for the communication of the warning to a remote security contact 40 such as the police or a security team. This communication of the central monitoring unit 24 with the remote security would be handled by the aforementioned hard wire 36 using telephone lines, network computer lines, or other wired means of communication or could be accomplished also by the optical or radio transceivers 38 in a wireless fashion.

In addition to having the aforementioned means to detect the discharge of a firearm in the current best mode of the device 10, each detector unit 12 will have a means to identify the specific location of the detector unit 12 in the building. This is accomplished in a number of fashions the easiest of which would assign each detector unit an electronic serial number, G.P.S. location, or other location code 42 which is stored in on board memory in a memory storage device 44 or encoded computer chip. In the case of G.P.S. location, a G.P.S. receiving device could be located in each detector unit 12 to transmit global positioning information that could be used to determine the exact location by storing the coordinates determined on installation with the central control unit memory. Information about the exact location of each location code 42 and therefor each detector unit 12 is stored in a central memory storage device 43 which is in the central monitoring unit 24. Also sent optionally in the case of close proximity between detector units 12 would be a signal about relative strength of the sound received to thereby help determine which detector unit is closest 12 to the incident. Since the central monitoring unit 24 would essentially be a micro computer such memory storage and software operation using such memory would be in the format of a conventional personal computer widely used for such purposes. Or the central monitoring unit 24 could be a specially engineered computer housed in a small housing with the onboard memory, operating system, and communications components all connected in conventional fashion. Upon the determination of any installed detector 12 that a firearm has been discharged, the detector 12 will trip and will immediately communicate that information to the central monitoring unit 24 along with the onboard information about the tripped unit's location in the building.

As noted, upon receiving the output signal 23 communicated that a firearm discharge has been detected in the structure, the central monitoring unit uses an address decoder 50 to determine the exact location of the tripped detector unit 12. Location determination is accomplished by the onboard address decoder 52 using onboard software to immediately search the onboard memory about detector unit 12 locations and determine the exact location of the detector unit 12 having been tripped. In the event that an alarm signal is sent by more than one detector unit 12, the aforementioned relative strength information of the signal sent will be determined to determine location of the gunshot.

Thereafter the central monitoring unit 24 will concurrently communicate to all other detector units 12 in the structure to issue the chosen means of wire or wireless communication for an alarm activation signal. Optionally the tripped unit might also be activated to emit an alarm. Concurrently, the central monitoring unit can use a means to communicate the alarm to a remote station such as the police by using a network card, modem, or auto dialer 54 to communicate with a remote site about the emergency. In the case of a modem or autodialer 54 a digital voice playback device 56 could transmit a prerecorded message to the police or security on connection therewith by the autodialer 54. In the case of a network card over the internet a prerecorded text message would be sent about the location of the problem. The alarm signal as noted earlier can be one or a combination of the audible alarm 30 such as a siren, buzzer, beeper, or recorded voice, and visible alarm 32, such as the LED or light.

In the current best mode, the visible alarm 30 would feature a light or LED having exit directional indicators 42 thereon. The exit directional indicator 42 would be akin to a blinking arrow 45 that not only visually announces the alarm of a gunshot, it directs occupants toward an exit away from the gun shot and out of harm's way. This exit direction is quite different than a conventional fire alarm in that the best way out of a building during a fire, is the shortest route since fire and smoke or the chief dangers and time is of the essence. However in an armed confrontation, the best way out of the building is the route away from the party firing shots since time is not a factor. As such, inclusion of the directional indicator 42 to indicate the safest route from the structure to avoid the firearm, and not just the shortest route as in a fire, would be of significant advantage to occupants seeking safety during a firearm crisis.

Other means to detect a firearm also could optionally be used in more complex versions of the device 10 using digital technology. In such an embodiment of the device the digital fingerprint of recorded gunshots, much like conventional voice prints, would be stored in a library of digitized firearm sounds 46 in the central memory 43 or in the detector unit 12 onboard memory 44 depending on which component is chosen to process the information received from the transducer 14. The received sound or sonic information from the amplifier 18 would then be passed through an analog to digital converter 48 and digitized. The digitized information would be communicated through a comparator 50 which would compare the received digitized sound to the library of sounds 46 in memory. If there is a match under comparison criteria of the received sound to the digitized sounds in the library 46 the detector unit 12 in the specific location in which the sounds were captured will be considered tripped and the aforementioned alarm sequence to the other detector units 12 and/or to a remote security contact 40 will be initiated. This embodiment would of course require a computer processing unit to receive, process and compare the information about the captured sound from the detector unit 12 and in the current best mode the computer with memory and central processing unit (CPU) would reside in the detector unit 12, however it could also reside in the central monitoring unit 24 and accomplish the task at hand with is to identify the discharge of a firearm, and the exact location thereof to initiate the alarms.

An additional embodiment of the device 10 would be for the retrofit or addition to conventional installed fire and burglar alarm systems which use a central receiving unit for data from remote fire sensors. As noted earlier, such systems have no ability to detect the location of a firearm discharge in the proximity of any of the alarm sensors which generally look for smoke or heart. In a retrofit, the detector units 12 could be configured to communicate over existing means of communication wiring into or multiplexing into hard wired existing wires simply adding a channel to the wireless communication channels in a wireless system. By connecting the detector units 12 to the existing system, and upgrading or replacing existing central receiving unit to process the output signal 23 and thereafter activate the other detector units 12 to issue the alarm in either an audible alarm 30 or visual warning means 32 or both, the facility having a conventional fire alarm or burglar alarm system to warn occupants of the firearm discharge and direct the best exit mode or direction to the occupants. It is therefor anticipated that the disclosed device 10 could be retrofitted into existing alarm installations and provide the additional utility of firearm discharge detection, warnings to occupants, and exit directions, not now available on such systems.

While all of the fundamental characteristics and features of the Firearm Discharge Detection Device and Warning System have been shown and described, it should be understood that various substitutions, modifications, and variations may be made by those skilled in the art without departing from the spirit or scope of the invention. Consequently, all such modifications and variations are included within the scope of the invention.

What is claimed is:

1. A firearm discharge detection device and alarm system comprising:

a central monitoring unit, said central monitoring unit having an electrical power means communicating therewith for providing electrical power to components thereof;

at least one detector unit located in a location remote to said central monitoring unit, said detector unit connected to an electrical power source providing electrical power to components thereof, said detector unit having location information designating the specific location of said detector unit stored thereon for electronic transmission to said central monitoring unit;

said detector unit having a transducer for receiving sonic waves proximate to said detector unit and generating an input electronic signal proportional to the decibel level and duration of said sonic waves;

means to electronically detect the discharge of a firearm from the input electronic signal communicated from said transducer, and generate an electronic output signal signifying said discharge is detected;

means to communicate said electronic output signal and said remote location information to said central monitoring unit;

said central monitoring unit having a database stored in a memory component said database identifying the exact location of all of said detector units;

means to communicate an alarm signal to said detector units from said central monitoring unit; and alarm means located on each detector unit, said alarm means activated by receipt of said alarm signal from said central monitoring unit when said firearm discharge is detected.

2. The firearm discharge detection device and alarm system as defined in claim 1 further comprising:

said alarm means having a visual warning means with at least one warning light.

3. The firearm discharge detection device and alarm system as defined in claim 2 further comprising:

said warning light being a directional indicator light activated by said central monitoring unit which visually designates the best route of exit from the structure to avoid the location of the detected firearm discharge as determined by said central monitoring unit.

4. The firearm discharge detection device and alarm system as defined in claim 3 further comprising:

a second warning light, said second warning light activated by said central monitoring unit instead of said directional indicator light, said second warning light activated by said central monitoring unit when said central monitoring unit determines that exit is not possible without a path proximate to the site of the detected firearm discharge.

5. The firearm discharge detection device and alarm system as defined in claim 1 further comprising:

said alarm means having a audible alarm means.

6. The firearm discharge detection device and alarm system as defined in claim 2 further comprising:

said alarm means having a audible alarm means.

7. The firearm discharge detection device and alarm system as defined in claim 3 further comprising:

said alarm means having a audible alarm means.

8. The firearm discharge detection device and alarm system as defined in claim 4 further comprising:

said alarm means having a audible alarm means.

9. The firearm discharge detection device and alarm system as defined in claim 1 wherein said means to electronically detect the discharge of a firearm from the input electronic signal communicated from said transducer, and generate an electronic output signal signifying said discharge is detected comprises:

an amplifier which receives the said electronic input signal;

said amplifier communicating an amplified version of said electronic input signal to a signal filter;

said signal filter passing only portions of said electronic input signal between a predetermined high point and low point to a duration timing means;

said duration timing means examining the input signal for duration and passing said input signal therethrough only if said output signal fall into a predetermined time length; and said input signal if passed through from said duration timing means transformed to an output signal by a trigger means and communicated to said central monitoring unit.

10. The firearm discharge detection device and alarm system as defined in claim 1 wherein said means to electronically detect the discharge of a firearm from the input electronic signal communicated from said transducer, and generate an electronic output signal signifying said discharge is detected comprises:

an amplifier which receives the said electronic input signal;

said amplifier communicating an amplified version of said electronic input signal to an analog to digital converter thereby transforming said input signal to digital format;

said digital format of said input signal being communicated to a microprocessor having a library of digitized firearm fingerprints stored in an onboard memory;

said microprocessor comparing said digital format of said input signal to said library and generating said output signal should said input digital format of said input signal match one of the digitized firearm fingerprints, said output signal thereafter communicated to said central monitoring unit.

11. A firearm discharge detection device and alarm system comprising:

a central monitoring unit, said central monitoring unit having an electrical power means communicating therewith for providing electrical power to components thereof;

at least one detector unit located in a location remote to said central monitoring unit, said detector unit connected to an electrical power source providing electrical power to components thereof, each said detector unit having specific identification information individually identifying said detector unit;

said detector unit having a transducer for receiving sonic waves proximate to said detector unit, said transducer generating an input electronic signal proportional to the decibel level and duration of said sonic waves;

means to communicate said input electronic signal to said central monitoring unit;

means to electronically identify the discharge of a firearm from the input electronic signal communicated from said transducer and generate an electronic output signal signifying said discharge is detected;

said central monitoring unit having a database stored in a memory component, said database identifying the specific location of all of said detector units from their identification information;

means to communicate an alarm signal to said detector units from said central monitoring unit when said electronic output signal signifies a firearm discharge; and alarm means located on each detector unit, said alarm means activated by receipt of said alarm signal from said central monitoring unit when said firearm discharge is detected.

12. The firearm discharge detection device and alarm system as defined in claim 1 further comprising:

said alarm means having a visual warning means with at least one warning light.

13. The firearm discharge detection device and alarm system as defined in claim 12 further comprising:

said warning light being a directional indicator light activated by said central monitoring unit which visually designates the best route of exit from the structure to avoid the location of the detected firearm discharge as determined by said central monitoring unit.

14. The firearm discharge detection device and alarm system as defined in claim 13 further comprising:

a second warning light, said second warning light activated by said central monitoring unit instead of said directional indicator light, said second warning light activated by said central monitoring unit when said central monitoring unit determines that exit is not possible without a path proximate to the site of the detected firearm discharge.

15. The firearm discharge detection device and alarm system as defined in claim 11 further comprising:

said alarm means having a audible alarm means.

16. The firearm discharge detection device and alarm system as defined in claim 12 further comprising:

said alarm means having a audible alarm means.

17. The firearm discharge detection device and alarm system as defined in claim 13 further comprising:

said alarm means having a audible alarm means.

18. The firearm discharge detection device and alarm system as defined in claim 14 further comprising:

said alarm means having a audible alarm means.

* * * * *